United States Patent [19]

English et al.

[11] Patent Number: 4,728,857

[45] Date of Patent: Mar. 1, 1988

[54] VERTICAL RUNNING, HIGH BRIGHTNESS, LOW WATTAGE METAL HALIDE ARC LAMP

[75] Inventors: George J. English, Reading, Mass.; Paul A. Reiser, Manchester, N.H.

[73] Assignee: GTE Products Corporation, Danvers, Mass.

[21] Appl. No.: 557,402

[22] Filed: Nov. 30, 1983

Related U.S. Application Data

[63] Continuation of Ser. No. 277,798, Jun. 29, 1981, abandoned.

[51] Int. Cl.[4] ..... H01J 61/20; H01J 61/06

[52] U.S. Cl. ..... 313/642; 313/631; 313/639

[58] Field of Search ..... 313/631, 639, 642

[56] References Cited

U.S. PATENT DOCUMENTS

| | | | |
|---|---|---|---|
| 3,514,659 | 5/1970 | Gungle et al. | 313/641 |
| 4,302,699 | 11/1981 | Keeffe et al. | 313/642 X |
| 4,308,483 | 12/1981 | Keeffe et al. | 313/626 X |
| 4,360,756 | 11/1982 | Spencer et al. | 313/601 X |

*Primary Examiner*—Palmer C. DeMeo

*Attorney, Agent, or Firm*—William H. McNeill; Martha Ann Finnegan

[57] ABSTRACT

A miniature, low-wattage, discharge lamp operable on direct current employs substantially parallel electrodes sealed in a single press seal. The electrodes are configured to provide an arc which is substantially parallel to the longitudinal axis of the lamp with the cathode being substantially longer than the anode. Heat generated at the anode is dissipated through the seal to the cathode allowing the cathode to operate hot enough to be stable. The chemical fill for the lamp employs a mol ratio of thorium to cesium to permit good light output and good color rendition.

1 Claim, 6 Drawing Figures

VERTICAL RUNNING, HIGH BRIGHTNESS, LOW WATTAGE METAL HALIDE ARC LAMP

This application is a continuation, of application Ser. No. 277,798, filed June 29, 1981, and now abandoned.

TECHNICAL FIELD

This invention relates to arc discharge lamps and more particularly to miniature arc dischage lamps. Still more particularly, the invention relates to single ended arc lamps capable of utilizing a D.C. power source as well as 60 Hz and 20 KHz power sources while delivering a light output of from 75,000 to 100,000 cd/in$^2$ at a power consumption of about 100 watts.

BACKGROUND ART

Direct current operable arc discharge devices generally are double-ended and require an anode electrode having a mass considerably larger than the cathode owing to the greater power input which must be dissipated. Since the anode fall voltage is generally much less than the fall of the cathode, this disproportionate anode input results principally from a combination of three factors, viz.: (a.) the electrons give energy to the anode upon entering as they drop into the conduction band; (b.) the fractional electron emission cools the cathode by the inverse process of (a.); and (c.) the fractional electron current component at the anode being higher than the cqrresponding fractional ion current at the cathode offsets much of the electrode fall difference which would otherwise tend to favor preferential cathode heating.

These conditions have led the prior art to employ relatively large anodes and small, pointed cathodes to balance electrode heating. This solution, however, leads to discharge instability, which occurs when the cathode temperature falls too low for favorable thermionic emission.

DISCLOSURE OF INVENTION

It is, therefore, an object of the invention to obviate the disadvantages of the prior art.

It is another object of the invention to provide an enhanced arc discharge lamp.

These objects are accomplished, in one aspect of the invention, by the provision of a miniature, low-wattage, arc discharge lamp having a glass body which defines an arc chamber having therein an arc generating and sustaining medium. An anode electrode and a cathode electrode, having substantially the same diameter and being parallel for a portion of their length, terminate within the arc chamber and define an arc gap therebetween. The electrodes are configured so that any arc formed during lamp operation is substantially parallel to the longitudinal axis of the lamp. The anode electrode is consideraby shorter than the cathode electrode, and the entire press seal dissipates the heat generated at the electrode surface. The longer cathode electrode operates hot enough to be a stable cathode primarily by sharing the heat developed in the common press seal.

The lamp employs a fill which includes a mol ratio of thorium to thorium plus cesium to provide a stable arc having a desired color temperature and a desired light output at a low power consumption.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 2:
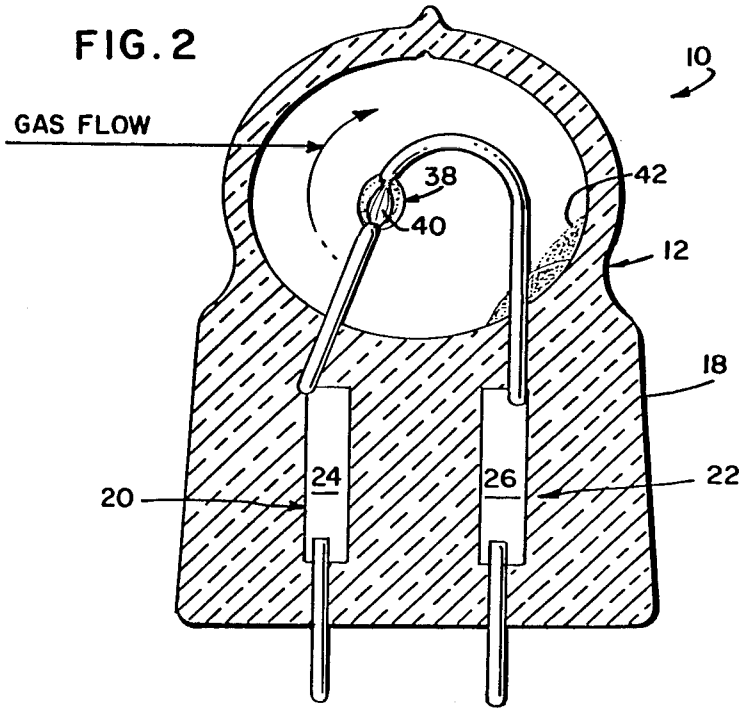
FIG. 2 is a sectional, elevational, diagrammatic view of an operating lamp.
Figure 1:
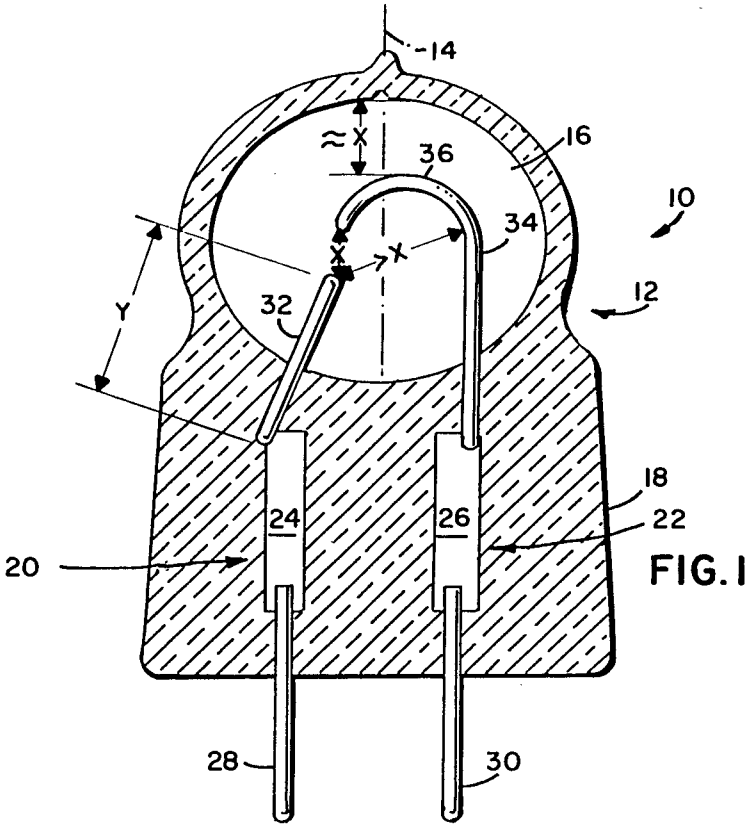
FIG. 1 is a sectional, elevational view of a lamp illustrating an embodiment of the invention.

Referring now to the drawings with greater particularlity, there is shown in FIG. 1 a miniature arc discharge lamp 10 having a glass body 12 with a longitudinal axis 14. Body 12 defines an arc chamber 16 and a seal area 18. Arc chamber 16 has a volume of less than 1 cm$^3$ and, preferably, has a volume of about 0.35 cm$^3$.

An anode electrode 20 and a cathode electrode 22 are sealed within seal area 18 by means of intermediate sealing portions 24 and 26 respectively. The sealing portions can be strips of molybdenium foil, as is known. First ends 28 and 30 project outwardly from seal area 18 to allow connection to appropriate circuitry and second ends 32 and 34 terminate within arc chamber 16. The electrodes 20 and 22 are substantially parallel to each other and to longitudinal axis 14. The electrodes 20 and 22 are substantially the same diameter, although, if desired, the anode (electrode 20) can have a diameter about 10% greater than that of the cathode.

Anode electrode 20 is substantially straight and has a length "y", measured from the intermediate portion to the terminating end, while the cathode electrode 22 is substantially longer when measured from the same points. To accommodate the increased length and to provide a substantially vertical arc, i.e., an arc whose axis will be within 0° to 45° of the longitudinal axis 14 (see FIG. 4), the cathode electrode 22 has its terminating end 34 curved back on itself to approach the terminating end of anode 20 (see FIGS. 1–4). The gap remaining between the ends of electrodes 20 and 22 defines the arc length "x". In the preferred embodiment, the substantially longer cathode electrode 22 will have a length greater than $2y+x$. As can be seen from FIG. 1, the cathode electrode 22 is further configured so that the uppermost portion 36 thereof is positioned a distance, approximately equal to "x", from the top wall of the arc chamber 16.

In a version of this lamp designed for low wattage operation, i.e., about 100 watts, the body 12 can be formed from a fused silica tube having a wall thickness of 1 mm and an I.D. of 8 mm. The electrodes can be fabricated from tungsten wire containing 1% thorium and having a diameter of about 0.019" (0.475 mm) and providing an arc gap ("x") of about 2.5 mm.

In lamps designed for operation at higher wattages (say, up to 300 watts) it is preferable to employ tubing having a 2 mm wall thickness and electrodes having diameters of about 0.023" (0.575 mm).

To insure that the arc forms between the terminating ends of electrodes 20 and 22, that gap must be the shortest distance between any two points between the electrodes.

Figure 3:
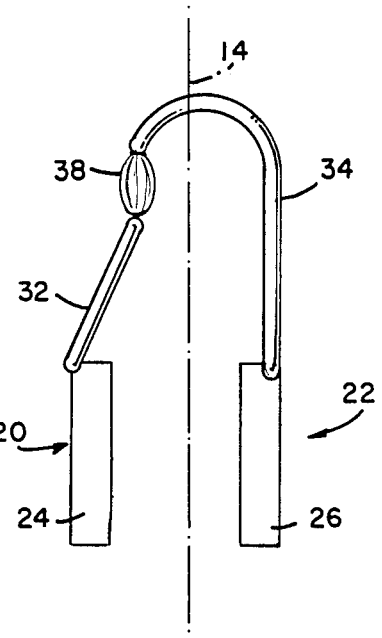
FIGS. 3 and 4 are partial views of electrode configurations in accordance with an aspect of the invention.
Figure 4:
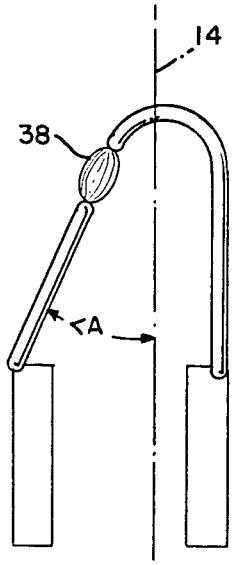

FIGS. 3 and 4 illustrate the substantially vertical arc 38. In FIG. 3 the arc 38 is shown as being parallel (0°) to the longitudinal axis 14. In FIG. 4 the arc 38 is shown as having an angle of about 15° with respect to longitudinal axis 14.

A preferred fill for lamp 10 includes mercury, iodine, thorium and cesium together with a gas fill of argon. For use as a projector lamp it is important that lamp 10 provide a stable arc having a color temperature between about 7000° K. to 9000° K. and a light output of between about 4000 lumens to 6000 lumens. To achieve these results it is necessary to provide a mol ratio of thorium to cesium (according to the formula Th/Th+Cs) of from greater than zero (>0) to about 0.4.

Figure 5:
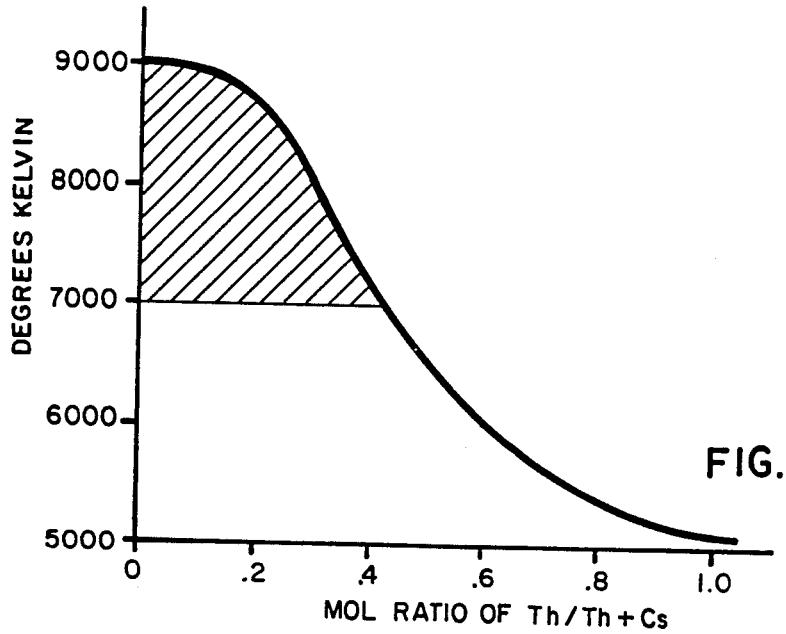
FIG. 5 is a graph of color temperatures available with lamps of the invention.
Figure 6:
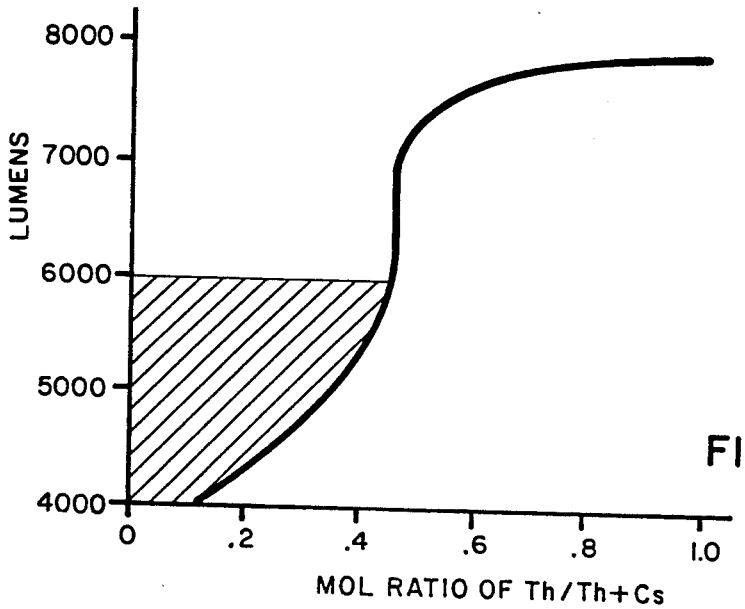
FIG. 6 is a graph of the light outputs available with the invention.

In a specific embodiment, a lamp 10 having the arc chamber volume discussed above (0.35 $cm^3$) is charged with a chemical fill of 15 mg Hg; 0.9 mg $HgI_2$; 2.4 mg $ThI_4$; 1.1 mg CsI; and argon to 250 torr. This fill provides a mol ratio of thorium to cesium (according to the formula Th/Th+Cs) of about 0.4. FIGS. 5 and 6 indicate that this mol ratio will provide a color temperature of about 7000° K. and a light output of about 5200 lumens. From the graphs of FIGS. 5 and 6 it will be seen that as the cesium content approaches zero (and thorium approaches unity) the lumen output drops and the color temperature rises. The thorium in the lamp appears to constrict the arc and to produce line spectra in the visible region while the cesium broadens the arc.

The addition of the cesium this adjusts the aspect ratio of the arc (the width to length), the brightness, the stability (ratios falling outside the shaded areas of FIGS. 5 and 6 produce unstable arcs with unacceptable color temperatures), the color temperature and the lumen output.

The amount of Cs in the arc 38 is a function of the wall temperature while the amount of thorium in arc 38 depends roughly on the electrode temperature. The amount of both elements in the arc is also dependent upon the amount of material in the arc chamber. The quantities described above provide an excess of material over stoichiometry which is constantly changing between the liquid and gaseous phase. The high iodine content helps to keep the walls of the chamber free from darkening materials. The hot gases flow out of and up from the core 40 of arc 38 (see FIG. 2) and then condense on the cold spot 42 of chamber 16. The liquid is then boiled off by the heat in the seal area 18.

Thus, by using the short electrode 20 as the anode and allowing seal area 18 to dissipate the heat generated at the electrode 20, heat balance is achieved. The long, staff shaped cathode 22 operates hot enough to be a stable cathode, primarily from sharing the heat developed in the common seal area 18.

While there have been shown and described what are at present considered to be the preferred embodiments of the invention, it will be apparent to those skilled in the art that various changes and modifications can be made herein without departing from the scope of the invention as defined by the appended claims.

We claim:

1. A miniature, low-wattage, arc discharge lamp comprising:

a glass body defining an arc chamber, said arc chamber having a volume of about 0.3 $cm^3$ to about 0.4 $cm^3$;

a pair of electrodes terminating within said arc chamber and defining an arc gap therebetween;

an arc generating and sustaining medium within said arc chamber, wherein said arc generating and sustaining medium comprises a chemical fill of about 15 mgs of Hg; 0.9 mgs $HgI_2$; 2.4 mgs $ThI_4$; 1.1 mgs CsI; and about 250 torr argon; and a mol ratio of thorium to thorium plus cesium to provide a substantially stable arc which provides a color temperature between about 7000° K. to 9000° K. and a light output of about 4000 to 6000 lumens, said mol ratio of thorium to thorium plus cesiium being greater than 0 up to about 0.4.

* * * * *